US005828040A

United States Patent [19]

Risman

[11] Patent Number: 5,828,040

[45] Date of Patent: Oct. 27, 1998

[54] RECTANGULAR MICROWAVE HEATING APPLICATOR WITH HYBRID MODES

[75] Inventor: Per O. Risman, Harryda, Sweden

[73] Assignee: The Rubbright Group, Inc., Eagan, Minn.

[21] Appl. No.: 455,114

[22] Filed: May 31, 1995

[51] Int. Cl.[6] ..... H05B 6/74; H05B 6/78

[52] U.S. Cl. ..... 219/695; 219/746; 219/750; 219/756; 219/700; 333/228

[58] Field of Search ..... 219/693, 690, 219/695, 696, 698, 700, 701, 745, 746, 750, 756, 762; 333/227, 228

[56] References Cited

U.S. PATENT DOCUMENTS

| | | | |
|---|---|---|---|
| 2,500,752 | 3/1950 | Hanson et al. | 219/693 |
| 3,177,333 | 4/1965 | Lamb | 219/693 |
| 3,210,511 | 10/1965 | Smith | 219/10.55 |
| 3,745,292 | 7/1973 | Couasnard | 219/694 |
| 3,764,770 | 10/1973 | Saad | 219/10.55 |
| 3,843,862 | 10/1974 | Staats et al. | 219/750 |
| 3,845,267 | 10/1974 | Fitzmayer | 219/750 |
| 3,855,440 | 12/1974 | Staats | 219/750 |
| 3,961,152 | 6/1976 | Staats | 219/750 |
| 5,400,524 | 3/1995 | Leconte et al. | 219/695 |

FOREIGN PATENT DOCUMENTS

| | | | |
|---|---|---|---|
| 1924523 | 11/1970 | Germany . | |
| 1931703 | 1/1971 | Germany . | |
| 3120900 | 6/1983 | Germany | H05B 6/64 |

*Primary Examiner*—Philip H. Leung
*Attorney, Agent, or Firm*—Faegre & Benson

[57] ABSTRACT

A microwave applicator of microwave reflective material having a closed first end, four side walls and, in a first embodiment, an open second end spaced apart from and facing a ground plate, the ground plate extending in a pair of transverse directions and having a longitudinal direction perpendicular thereto, and in a second embodiment, a closed second end, the applicator forming a cavity containing a desired hybrid mode having a low wave impedance in the longitudinal direction and an absence of an E field component in one of the transverse directions.

34 Claims, 3 Drawing Sheets

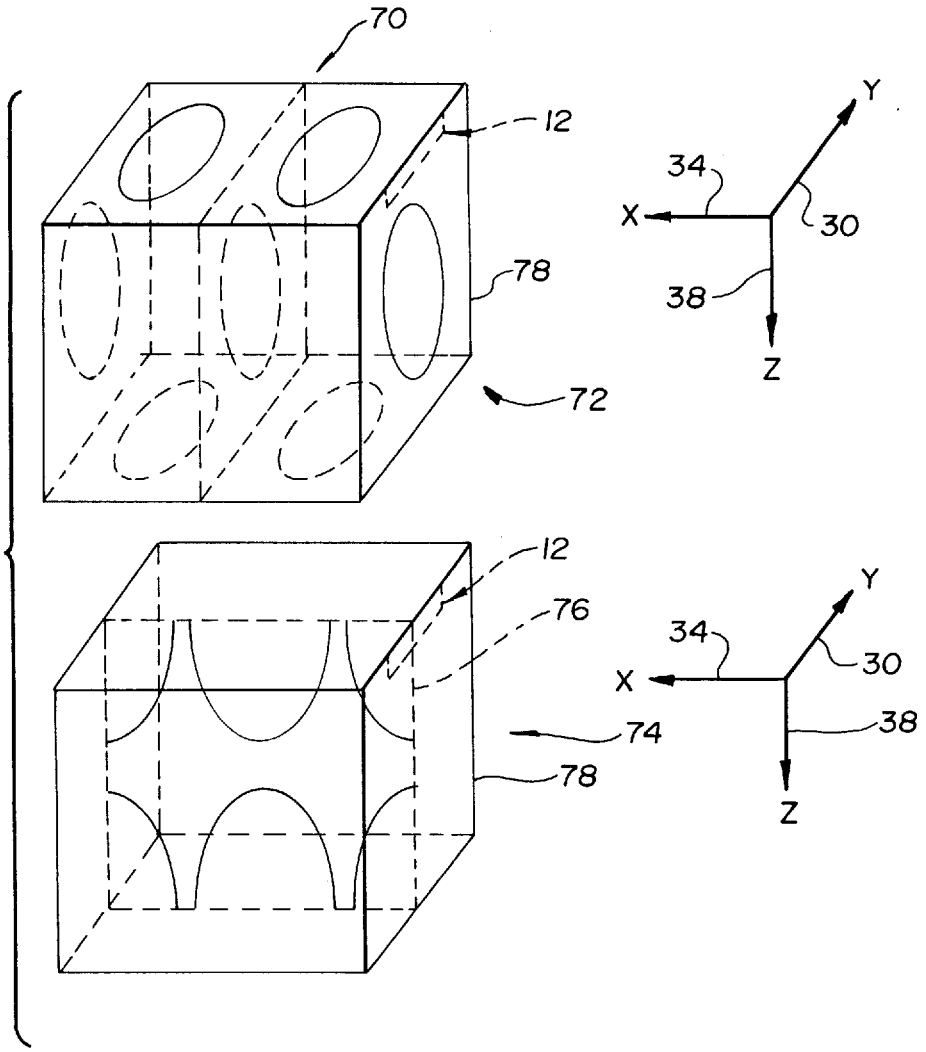
*Fig. 3*
*Fig. 4*
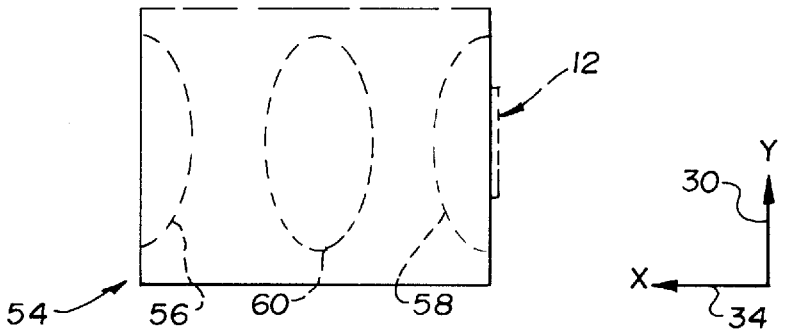

RECTANGULAR MICROWAVE HEATING APPLICATOR WITH HYBRID MODES

FIELD OF THE INVENTION

The present invention is directed to the field of microwave applicators, particularly in one embodiment to those applicators having an open end for heating a load exterior of and generally adjacent to the open end of the applicator, as for example, on a microwave transparent conveyor, and in another embodiment to a closed applicator.

BACKGROUND OF THE INVENTION

A dominating problem with prior art microwave applicators is a tendency to uneven heating of loads. There are several reasons for this, with one of the most important occurring when the microwave wavelength is comparable (or close in size) to one or more of the characteristic dimensions of the workload. The workload is typically a dielectric (such as food) with rather high complex relative permittivity $\epsilon$ and relative permeability of 1. The energy absorption is generally described in prior art systems as being through the electric (E) field, which has a periodicity of about ¼ of a transverse guide wavelength between maxima and minima of the heating pattern. These electric field maxima and minima produce uneven heating in the workload. Another reason for such uneven heating is the creation of particular configurations (or modes) of the electromagnetic field in the cavity, which typically remain stationary in the cavity.

One prior art approach to solving this uneven heating problem is to move the load in relation to the applicator structure during heating. A specific example of this is a microwave oven containing a rotating turntable on which the load is placed. Another example is a tunnel oven, where translation of the load is accomplished by a moving belt or similar apparatus. However, prior art approaches have been found to be deficient in failing to properly average the heating over a cycle of rotation or a passage past the applicator (or a set of applicators).

Another source of uneven heating is the diffraction phenomena which become quite significant with high permittivity loads. In particular, a so-called "edge overheating" effect has been observed and can be explained by the direct coupling of an E field component parallel to an edge of the load.

It is to be understood that the impedance of dielectric workloads may be approximated by $|\epsilon|$, since the relative loss factor $\epsilon''$ is typically less than half of the relative real permittivity $\epsilon'$ (where $\epsilon=\epsilon'-j\epsilon''$). This impedance determines the energy transfer from a field in the cavity to the workload. In general, wave impedance can be considered to be a vector in the direction of propagation. When the load permittivity is high, the wavetype in it becomes similar to a TEM wave, the impedance of which is $\eta_0/\sqrt{|\epsilon|}$, where $\eta_0$ is the impedance of free space. In such a situation the load impedance, $\eta_{g\epsilon}$, is less than $\eta_0$.

In a vertically-directed, constant crosssection waveguide the direction of propagation of the microwaves is vertical and is used herein as a reference direction. In such a waveguide (or cavity) it is well-known that there may be three classes of modes: TE, TM, and hybrid. TE modes (transverse electric) have no E (or electric field) component in the direction of propagation (vertical, in this case), and TM modes (transverse magnetic) have no H (or magnetic field) component in the direction of propagation. (With a vertical reference direction, it is to be understood that the transverse direction will be horizontal.) As is well known, TE modes have impedances higher than $\eta_0$, whereas TM mode impedances are lower than $\eta_0$. The wave reflection at a boundary becomes zero when there is impedance equality across it. Hybrid modes are normally described as vectorial combinations of TE and TM modes. Such combinations can in general be characterized by the lack of an E or H field component in other than the Z direction.

It is to be understood that, as used herein, when a surface is referred to as being "directed," the direction indicated is perpendicular to the plane of the surface, e.g., a "z-directed" surface is in the x-y plane.

SUMMARY OF THE INVENTION

The present invention addresses the above noted problems associated with uneven and inefficient heating by providing a microwave heating system for heating loads, particularly low profile or "flat" loads, with the heating system including an applicator, a microwave energy source and a waveguide or other feed system connected thereto via one or more feed openings for supplying microwave energy from the energy source via the applicator to the load. More particularly, the applicator of the present invention has a rectangular cross-section, with one closed and one open end, each of which are "z-directed." A generally planar microwave reflective surface or plate is spaced apart from the open end of the applicator, and is also "z-directed." A microwave containment cavity is formed by the applicator and plate and is defined to be the volume within the applicator together with the volume defined by the region between the open end of the applicator and the conductive surface spaced therefrom. The rectangular, open-ended microwave applicator is fed in its top region and operates at a predetermined frequency. The enclosure forming the cavity has first and second transverse dimensions ("a" and "b") and a longitudinal dimension ("$h_c$," the effective height) in the direction of propagation of microwave energy, where each of the first and second transverse dimensions are sized to support only one or more hybrid modes having a low longitudinal (or vertical) impedance.

In a preferred embodiment, the applicator has a flange surrounding the open end directed toward the load. The flat conductive surface or ground plate is preferably spaced apart from the open end of the applicator by a distance sufficient to permit insertion and withdrawal of the load as, by way of example, by a microwave-transparent conveyor passing through the space between the open end of the applicator and the spaced conductive surface. In addition, the flanges and spacing to the ground plate are sized to prevent substantial microwave leakage from the cavity.

With respect to the edge overheating aspect, if the only E field component present is perpendicular to the edge, no "edge overheating" occurs at that edge.

For relatively flat, horizontally disposed loads, it is therefore favorable to design the heating system so that high horizontal E field components are avoided or kept at a relatively weak level, particularly near the edge regions of an essentially flat horizontally extended workload. It is to be noted that edge overheating can occur even if the load is moving, as for example, in the conveyor systems mentioned above since the concentration effect is determined by the edge. The present invention is characterized by an absence of a transverse E field component in one of the first or second transverse directions such that a load placed adjacent the open end of the applicator is evenly heated without edge overheating.

OBJECTS OF THE INVENTION

The first object of the invention is to provide a microwave heating system which has the favorable properties of creating an even heating of a continuous or piece-by-piece, essentially flat load passing under one or more open-ended applicators, without the load having interior or edge cold spots or hot spots in the heating pattern. This object is achieved by using one or more hybrid modes which lack a horizontal E field component. Another object of the invention is to achieve high efficiency, in part by using hybrid modes as described above which also have a low impedance in the direction of propagation. Other objects are to use an applicator and feed which is as small as possible consistent with achievement of the aforementioned objects, to maximize efficiency by using cavity modes which are frequency broadband, and to use cavity modes which have a minimal microwave energy leakage away from the applicators. These objects achieved by using desired hybrid modes which have a low impedance and which simultaneously have the absence of one horizontal E field component, and by eliminating or reducing the effectiveness of undesired modes which may either be present or possible in the cavity.

These objects are obtained by an applicator having the desirable properties mentioned along with a feed system adapted to it. A particular embodiment is disclosed in the following detailed description, but it is to be understood that the invention is not to be limited to this embodiment; other sets of dimensions and other mode combinations may be used. Furthermore, other variations may be made while still remaining within the spirit and scope of the invention hereof; for example, multiple feeds to the applicator may be used in the practice of the present invention to further the dominance of the desired modes.

BRIEF DESCRIPTION OF THE DRAWINGS

FIG. 3 shows greatly simplified views of the H fields at the walls of the cavity and E fields in a central plane of the cavity of the applicator of FIG. 1.

FIG. 4 shows a top plan view of a greatly simplified view of the heating pattern produced by the applicator of FIG. 1.

DETAILED DESCRIPTION

Figure 1:
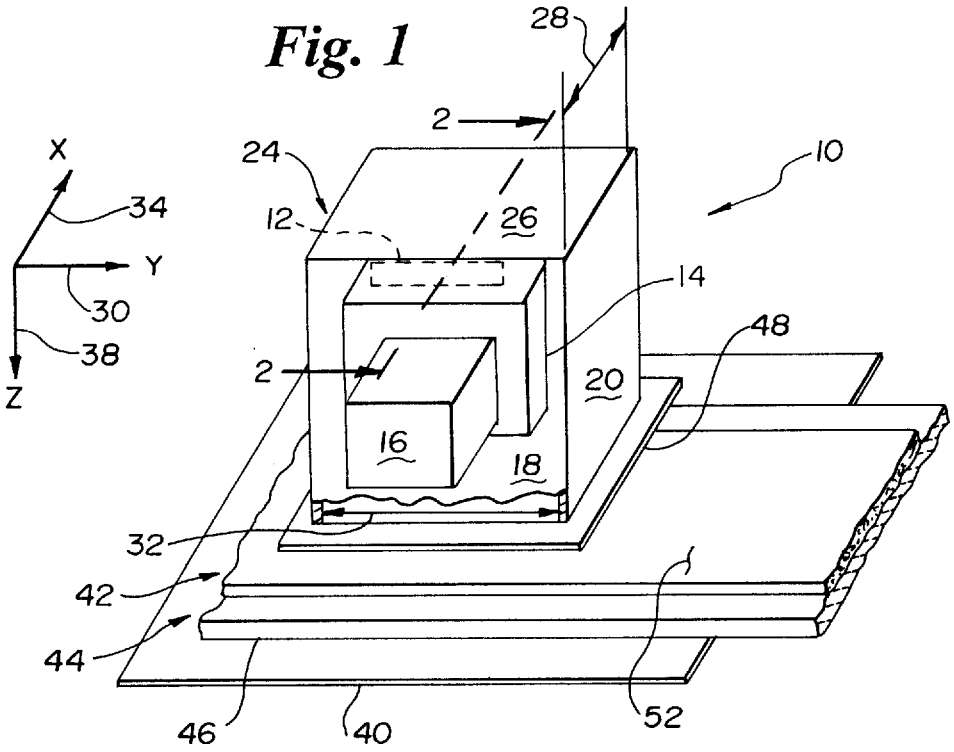
FIG. 1 is a perspective view of an applicator (with a portion cut away) and ground plate useful in the practice of the present invention.
Figure 2:
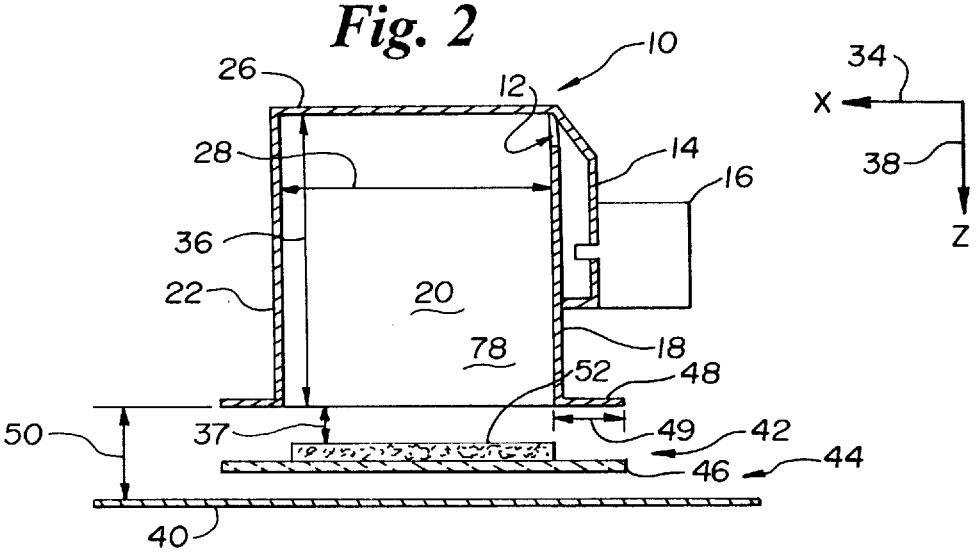
FIG. 2 is a section view of the applicator and ground plate of FIG. 1 taken along line 2—2 and including a continuous workload and supporting conveyor.

Referring now to the Figures and most particularly to FIG. 1, a simplified view of an applicator 10 useful in the practice of the present invention may be seen. Applicator 10 has a feed port or slot 12 fed by a conventional $TE_{10}$ waveguide 14. It is to be understood that this embodiment is intended for a predetermined frequency of operation of 2450 MHz with a magnetron 16 as the microwave source. The applicator 10 is made up of four sides 18, 20, 22, 24 and a top or roof 26. As may be seen most clearly in FIG. 2, applicator 10 has a rectangular cross section with an interior "a" dimension 28 along an x-axis direction 34, an interior "b" dimension 32 along a y-axis direction 30, and an interior height or "h" dimension 36 along a z-axis direction 38. It is to be understood that applicator 10 will have a square cross section when a and b dimensions 28 and 32 are equal. A horizontal metal plane or plate 40 is positioned in an x-y plane below the applicator 10 and a load 42 to be heated is carried by a support 44 which may include a moving belt of a microwave-transparent material 46. Applicator 10 has outwardly directed flanges 48 spaced a distance "$h_0$" 50 from the metal plane 40. It is to be understood that the load 42 may be a continuous strip of material, or a single piece, or a succession of discrete pieces. Load 42 is often a foodstuff, but the present invention is not limited to operation therewith, as other materials thermally responsive to the application of microwave energy may be irradiated by an embodiment of the present invention. As has been mentioned, the present invention is most suitable for use with load configurations having a low aspect ratio, i.e., a low or short load height (in the z direction) relative to the horizontal load dimensions (in the x and y directions).

It is to be understood that the distance 36 from the interior of the roof 26 to the plane of the flanges 48 plus the distance to the reflective surface parallel to and opposing the roof 26 will be the effective height, $h_c$, of a cavity 78 of applicator 10. For a continuous load 42 which covers or extends entirely across the open end of cavity 78, the effective height, he, is the sum of dimensions h 36 and $h_1$ 37. For a load 42 made up, for example, of a plurality of small discrete pieces, the effective height of the cavity is more accurately approximated by the sum of the dimensions h 36 and $h_0$ 50, extending from the interior of roof 26 to the surface of plate 40 facing the applicator 10. However, it is to be understood that, in practice, the difference may not be significant.

In the practice of the present invention, the a dimension 28, b dimension 32, and the effective height $h_c$ (which is the sum of h dimension 36 and a distance between the $h_0$ dimension 50 and the $h_1$ dimension 37, depending upon the configuration of the load 42) and the type and position of the energy feed aperture 12 are selected for dominance of one hybrid mode.

It has been found that TM modes and hybrid modes sharing certain properties of TM modes are more favorable for heating purposes, since they can be more easily matched to the low impedance of typical loads, and therefore minimal reflections are built up. Using such modes avoids the necessity of careful and precise determination or adjustment of the cavity height and coupling factor to become efficient at resonance as is required with the use of TE modes. In addition, conditions for reflectionless transmission in at least a thick load that covers the whole horizontal cross section of the waveguide can be established.

This reflectionless condition, where the impedance of the load is equal to the impedance in the open waveguide, is analogous to the so-called Brewster condition for free-space obliquely incident light waves, and is determined by Equation (1) which gives the normalized wavelength $\nu_B$ in terms of the permittivity $\epsilon$ of the load as follows:

$$\nu_B^2=|\epsilon|/(|\epsilon|+1) \tag{1}$$

where the normalized wavelength of a mode, $\nu$, is defined by $\nu=\lambda_0/\lambda_c=f_c/f$, it being understood that index c stands for the cut-off condition for an infinitely long waveguide carrying the mode. (It is to be understood that in the practice of the present invention, the free space wavelength, $\nu_0$, is about 12 cm for a preferred predetermined frequency of 2450 MHz, which is used in this description.)

The guide wavelength (in the direction of propagation) of the mode in the cavity is given by Equation (2) as follows:

$$\lambda_g = \lambda_0/\sqrt{1-\nu^2} \quad (2)$$

and thus becomes infinite (cutoff) for $\nu=1$, while $\nu=0$ represents the plane-wave (free space TEM) case.

The normalized wavelength, $\nu$, (for a cavity) is determined by the cavity cross section dimensions, as is evident from Equation (3) as follows:

$$\nu^2=(\lambda_0)^2[(m/2a)^2+(n/2b)^2] \quad (3)$$

where m and n are the number of half periods of the standing wave pattern in the respective transverse x and y directions, (and therefore will assume only integer values); and a and b are the waveguide dimensions in these respective directions. Values of $\nu$ larger than 1 will result in evanescent or "cut-off" propagation, i.e., an exponential decay of the field in a direction away from the excitation area.

Under the reflectionless condition for a TM or desired hybrid mode, the vertical height of the cavity does not influence the efficiency, since no vertical standing waves are built up. This condition means that good energy transfer and thus a good energy efficiency of the system is achieved. However, since the desirable p values are rather close to 1, operation may be quite sensitive to variations in cavity cross section dimensions. In other words, for proper operation the "a" and "b" dimensions must be closely controlled since a small difference in one or both will result in a comparatively large difference in $\lambda_g$.

In a rectangular waveguide, except for the $TE_{On}$ and $TE_{m0}$ modes, all TE modes have H fields in all directions and lack an E field in the direction of propagation, while all TM modes have E fields in all directions and lack an H field in the direction of propagation. It is evident from Equation (3) that some modes may have the same $\nu$; these are called degenerate modes. They can be separated only by proper excitation, so that only one of the modes is excited. If the cross section is, for example, a regular square, mode degeneracies will, of course, be more common. The field patterns of degenerate modes can often be vectorially combined into simpler patterns of hybrid modes. For rectangular waveguides with the z direction being that of propagation, one can then designate the hybrid modes as x- and y-directed, for example, TEx, TMy, TEz modes. (It is to be understood that the subscript indicates the direction of the missing field component, i.e., for a TEx mode, Ex is missing; for a TMy mode, Hy is missing. For a TEz mode the z directed component of the electric field is missing which makes it an ordinary TE mode. It is also to be noted that a hybrid mode with a z subscript is by definition an "ordinary" mode.)

These hybrid modes are then still characterized by the lack of one of the six field components in the designated direction, as for the "regular" TE and TM modes. They are in principle equal to those "regular" modes by just being "rotated" by 90°. However since the direction of propagation and the load position is different as compared with TE and TM modes some of their properties become modified. One of these major properties is impedance. For TMz, TEy, and TEz modes these impedances are given by Equation (4), in a waveguide (or cavity) where the cross section is filled with a dielectric of relative permittivity $\epsilon$:

$$(TMz)\ \eta_g = (n_o\sqrt{|\epsilon|-\nu^2})/|\epsilon| \quad (4)$$

-continued $$(TEy)\ \eta_g = (n_o\sqrt{|\epsilon|-\nu^2})/[|\epsilon|-(n\lambda_o/2b)^2]$$

and $$(TEz)\ \eta_g = \eta_0|\epsilon|/\sqrt{|\epsilon|-\nu^2}$$

where $\epsilon=1$ for empty space in the waveguide.

It has been found that only hybrid TEx or TEy type modes have the requisite desired property of lacking one horizontal (or transverse) E field component. The position of the feed slot 12 determines if a TEx or TEy mode is excited; in the embodiment shown, the TEy type modes are excited. In the practice of the present invention, a $TEy_{21}$ mode is a desired mode, giving maximum coupling to the load 42 if the effective cavity height, $h_c$, is approximately $p\lambda_g/2$, where p is an integer. For the reflection at the load 42 to be small, the mode should be (or behave similarly to) a TMz (TM) mode. The mode should also have a high normalized wavelength $\lambda$, to obtain a low wave reflection at the upper surface 52 of the load 42 (for continuous or near continuous loads 42). To minimize the mode impedance [and referring to the portion of Equation (4) relating to the TEy mode], the term $n\lambda_0/2b$ is minimized, by making n small (preferably equal to 1), or by selecting a large "b" dimension 32, or both.

Two examples are illustrated: the first is for drying relatively light loads or thawing frozen loads, each of which may be appropriately characterized by a dielectric constant having an absolute value of about 3. The second example is for compact, non-frozen loads where the dielectric constant is 9 or above. For purposes herein, a dielectric constant having an absolute value of 10 provides an acceptable approximation for loads with higher dielectric constants. As examples for respective starting points, TM modes are used to calculate the Brewster condition. For a relatively low load permittivity, $|\epsilon|=3$ gives $\nu_B=0.87$; and for a relatively high load permittivity, $|\epsilon|=10$ gives $\nu_B=0.95$.

In both examples, a square applicator is used for simplicity, however, the invention is to be understood to not be so limited, since unequal sided rectangular applicators are within the scope of the present invention and may be attractive for certain applications. Using Equation (1) with $|\epsilon|=3$, Equation (3) gives a side dimension for a and b of 158 mm when m=2 and n=1. For $|\epsilon|=10$, the side dimension for a and b becomes 144 mm with m=2 and n=1. Using Equation (2) the guide wavelength is 245 mm for the first example and 392 mm for the second example, when each is calculated for a predetermined operating frequency of 2450 MHz.

For Equation (4) to give a favorably low value, $(n\lambda_0/2b)^2$ should be <<1. For the two examples of square applicators with sides of 158 and 144 mm, the $(n\lambda_0/2b)^2$ term becomes 0.15 for the larger embodiment and 0.18 for the smaller embodiment, each of which is acceptable. The larger embodiment relates to the low permittivity load and the smaller embodiment to the high permittivity load. If a tolerance for the side dimension is selected as 7 mm, a single embodiment having a side dimension of 151 mm can be used for loads with permittivity $|\epsilon|$ between 3 and 10, and possibly with $|\epsilon|>10$, since higher permittivities do not "extend" or "extrapolate" the results linearly, but are more compressed because of the form of equation (1) where B approaches 1 as $|\epsilon|$ increases.

In order to obtain satisfactory matching of the microwave energy to the load, Equation (4) must be satisfied such that $\nu$ from Equation (4) approximates $\nu_B$ from Equation (1). Since $\nu^2$ is to be made approximately equal to $|\epsilon|/(|\epsilon|+1)$, for thawing or drying applications where $|\epsilon|=3$: $\nu=0.87$. For heating compact, non-frozen loads (characterized by $|\epsilon|=10$) $\nu$ will equal 0.95 as the normalized wavelength. For the reasons stated previously, higher values for $\nu$ are preferably avoided, and it has been found preferable to keep $\nu$ equal to or less than about 0.95, as a compromise.

The internal effective height "$h_c$" has previously been defined for discrete and continuous loads. For the first example, $h_c$ is preferably equal to about 123 mm or 246 mm. For the second example, $h_c$ is preferably equal to about 196 mm or 392 mm. While this process results in a resonant condition for the desired mode, it is to be understood to be within the scope of the present invention to encompass designs which are non-resonant for the desired mode or modes, thus permitting an additional degree of freedom in making the longitudinal height anti-resonant for undesired modes, if desired.

Returning to the specific examples, it is to be understood that the height of the cavity is preferably sized to make undesired modes, particularly the $TEy_{11}$ mode, non-resonant. For this mode, the guide wavelength is 146 mm in the larger applicator, and 153mm in the smaller applicator. Antiresonance exists when the height=$\lambda_g/4+q\lambda_g/2$, where q is an integer. When q=3 for the larger applicator, the desirable height is 255 mm. A second value with q=1 leads to a height of 110 mm which is questionable because, with this height, the $TEy_{11}$ mode may exist simultaneously, and distort the heating pattern somewhat. For the smaller applicator, selecting q=2 gives a height of 191 mm. It is also important that the height be selected to avoid making the undesired $TEz_{01}$ and $TEz_{02}$ modes resonant as well, using the same antiresonance criteria mentioned above. Excitation of the $TEz_{02}$ mode may be eliminated or kept at a minimum by careful placement of the excitation port in the center of the cavity wall. It may be kept in mind, however, that these modes (particularly the $TEz_{01}$ mode) have a relatively high impedance and thus a low coupling to the load 42 when the system is matched or sized for the desired $TEy_{21}$ mode. For the larger applicator, $\lambda_g$=133 and 193 mm for these $TEz_{01}$ and $TEz_{02}$ modes, respectively, giving a desired height of 245 mm for the $TEz_{01}$ mode with q=3, and a height of 241 mm for the $TEz_{02}$ mode, with q=2. Thus it may be seen that the height of 245 mm with the side dimension of 158 mm fulfills all the criteria for mode filtering of the undesired $TEz_{01}$ and $TEz_{02}$ modes while at the same time promoting or supporting the desired $TEy_{21}$ mode.

For the smaller example applicator, the corresponding $\lambda_g$ values are 135 and 232 mm for the undesired modes, while a height of 200 mm becomes resonant for the $TEz_{01}$ mode. The $TEz_{02}$ mode is not excited. Nevertheless, if the top surface of the load is controlled or limited to avoid a 200 mm effective height $h_c$, the smaller applicator dimensions mentioned may also work well.

Before the hybrid $TEy_2l$ mode is considered further, it should be noted that the undesired $TEz_{01}$, $TEz_{02}$, and $TEy_{11}$ modes may also exist and be excited by the coupling slot 12 in the case where the slot is slightly asymmetrically positioned or the load is inhomogeneous in a way that reflections from it induce any of these modes. Data for these modes in the square applicator having sides of 158 mm, and the desired $TEy_{21}$ mode are given in Table 1. Here $\eta_{g0}$ is the impedance in the air-filled portion of the waveguide or cavity, and $\eta_{g\epsilon}$ is the impedance in the dielectric filled portion (load) and the reflection factor is the fraction of power reflected from the load.

It should be noted that since this applicator is square, the modes with reversed indices can exist with the same properties. The modes with reversed indices are not excited due the symmetrical location of the feed. It is also to be noted that, to be exact, calculations should be performed using complex algebra. For practical purposes, however, calculations can be made using the absolute values of the complex permittivity in the equations noted, with negligible loss of accuracy.

TABLE 1

| Mode | $\nu$ | $\lambda_g$ (mm) | $\eta_{g0}/\eta_0$ | $\eta_{g0}/\eta_{g\epsilon}$ for $\lvert\epsilon\rvert = 3$ | $\eta_{g0}/\eta_{g\epsilon}$ for $\lvert\epsilon\rvert = 10$ | Reflection factor $\lvert r\rvert^2$ for $\lvert\epsilon\rvert = 3$ | Reflection factor $\lvert r\rvert^2$ for $\lvert\epsilon\rvert = 10$ |
|---|---|---|---|---|---|---|---|
| $TEz_{01}$ | 0.387 | 133 | 1.09 | 1.83 | 3.40 | 0.09 | 0.30 |
| $TEz_{02}$ | 0.774 | 193 | 1.58 | 2.45 | 4.84 | 0.18 | 0.43 |
| $TEy_{11}$ | 0.548 | 146 | 0.98 | 1.71 | 3.11 | 0.07 | 0.26 |
| $TEy_{21}$ | 0.866 | 245 | 0.59 | 1.12 | 1.91 | 0.00 | 0.10 |

It can thus be seen that the choice of a distance between the load 42 and applicator ceiling (in the longitudinal direction) of about 110 mm will result in effective anti-resonance conditions for the $TEz_{01}$ mode, since $3\lambda_g/4$ becomes about 100 mm for this mode. This mode will thus be essentially cancelled. The $TEz_{02}$ mode has a high impedance and becomes mismatched; its amplitude will become much less than that of the desired $TEy_{21}$ mode. The $TEy_{11}$ mode will not fulfill the conditions for resonance which are necessary for significant energy transfer to the load 42. As a result, the favorable low-impedance, well-matched and resonant $TEy_{21}$ mode will dominate. The influence of the $TEy_{11}$ mode can be tolerated as a slight imbalance between the strength of the major heating area lobes 56, 58, 60 illustrated in FIG. 4.

To avoid a zone of weak or no heating along the center b/2 zone under the waveguide of the applicator (which occurs with even values of mode index n) it has been found preferable to make the mode index n odd. Furthermore, n=3 is generally too large to give a suitably small or practical b dimension. Thirdly, the factor $(n\lambda_0/2b)^2$ must be much less than 1, which means that b must be significantly larger than $\lambda_0$. It is concluded that n=1 is the preferred choice for embodiments of the present invention. The index m can be 1, 2, 3, or larger. However, if m is larger than 3, the applicator may become too elongated both for practical integration in equipment and for reliable excitation by just one slot at a short wall. It is concluded that m=2 is the preferred choice for this mode index for embodiments of the present invention, since it fulfills all criteria and is the only index allowing a square applicator. For the lower ISM frequency near 915 MHz, $TEy_{11}$ may, however, be a preferred or desired mode due to the larger physical dimensions at that frequency (where all dimensions are multiplied by the factor 2450/915).

The desired $TEy_{21}$ hybrid mode pattern 70 is illustrated in FIG. 3. It is to be understood that although two rectilinear solids 78 are shown in FIG. 3, each is a separate representation of the same volume: that of the cavity 78 of applicator 10. Furthermore, the field pattern 70 in the cavity 78 has H and E components existing simultaneously; the H field pattern 72 and the E field pattern 74 are separated only for clarity of illustration. The H field pattern 72 is a simplified view of the magnetic field component of the $TEy_{21}$ mode at the walls or sides 18–24 and top 26 of the cavity, and the E field pattern 74 is a simplified view of the electric field component of the $TEy_{21}$ mode in a central plane 76 of the applicator interior volume or cavity 78. This field vanishes at the cavity walls specified by y=0 and y=b. Furthermore, it is to be noted that the desired $TEy_{21}$ mode has no transverse E field components, as illustrated in the simplified pattern 74 of FIG. 3.

Thus it may be seen that a narrow coupling slot as used herein provides a H field component along its major dimension, but only a perpendicular E field component. Since the H field lines are closed, the H field may have components in all directions some distance away from the slot in the interior or cavity of the applicator 10. However, the E field component is short circuited at the slot ends and must therefore be sinusoidal along the slot resulting in the absence of horizontal components of the E field along the major dimension of the slot. It has been found that in the practice of the present invention, a relatively long horizontal slot (about $\lambda_0/2$ or slightly longer) provides excitation of only the desired hybrid mode.

A similar slot in the ceiling or roof of the applicator 10 also gives a horizontal x-directed E field component. There is still no y-directed component. (The E field lines still behave as indicated in FIG. 3; the result becomes very similar for both slot positions). The main reason for preferring the slot in the side wall is that the mode wavelength along the short dimension of the slot is almost as short as possible when the slot is in the ceiling, whereas the mode wavelength is relatively long (typically $>2\lambda_0$) when the slot is placed in the side wall. Since the slot must have a physical size, it fits the field pattern better and disturbs the applicator pattern less if placed in the side wall close to the ceiling. In other words, the slot position is less sensitive (from a practical perspective) in the side wall than in the ceiling.

It is important to note that with the arrangement of the present invention, the resulting hybrid mode components are favorable, since there is only a very weak $E_x$ and no external $E_y$ field near each y-directed edge of the load 42, thus eliminating edge overheating along these edges. Furthermore, the $E_z$ field is weakened by a factor between $\sqrt{|\epsilon|}$ and $|\epsilon|$ in the load 42. This reduction in the $E_z$ field results in a primary energy transfer mechanism by displacement currents in the load induced by the horizontally directed H field component.

With continuous loads, it to be understood that it is preferable that the direction of transport be aligned with the missing E field component to avoid edge overheating of the continuous side edges of the load.

To achieve the second object of the invention (that the applicator 10 and its feed 14 should be small) the effective height $h_c$ (between $h+h_1$ and $h+h_0$) is desirably $\lambda_g/2$, because resonant conditions are desirable for achieving the best possible impedance matching for variable $|\epsilon|$ loads. The shortest height $h_c$ for this is about $\lambda_g/z$. In an embodiment similar to that shown in FIG. 1, the distance h is about 110 mm and the distance $h_0$ is about 35 mm for a 150×158 mm cross section applicator 10, with a thin, low permittivity load 42. The feeding waveguide 14 can conveniently be located at and affixed to a vertical applicator side, as at side wall 18 in FIGS. 1 and 2. Since the feed slot 12 is relatively small (typically 10×70 mm) and gives a well-defined field pattern as shown in FIG. 3, the proper mode field is established at a relatively small distance away from the feed aperture 12.

The objective of a high-efficiency frequency broadband system is inherently fulfilled by the low-impedance mode in the applicator cavity 78 provided there is no significant energy losses by leakage from the applicator 10 under consideration.

Figure 5:
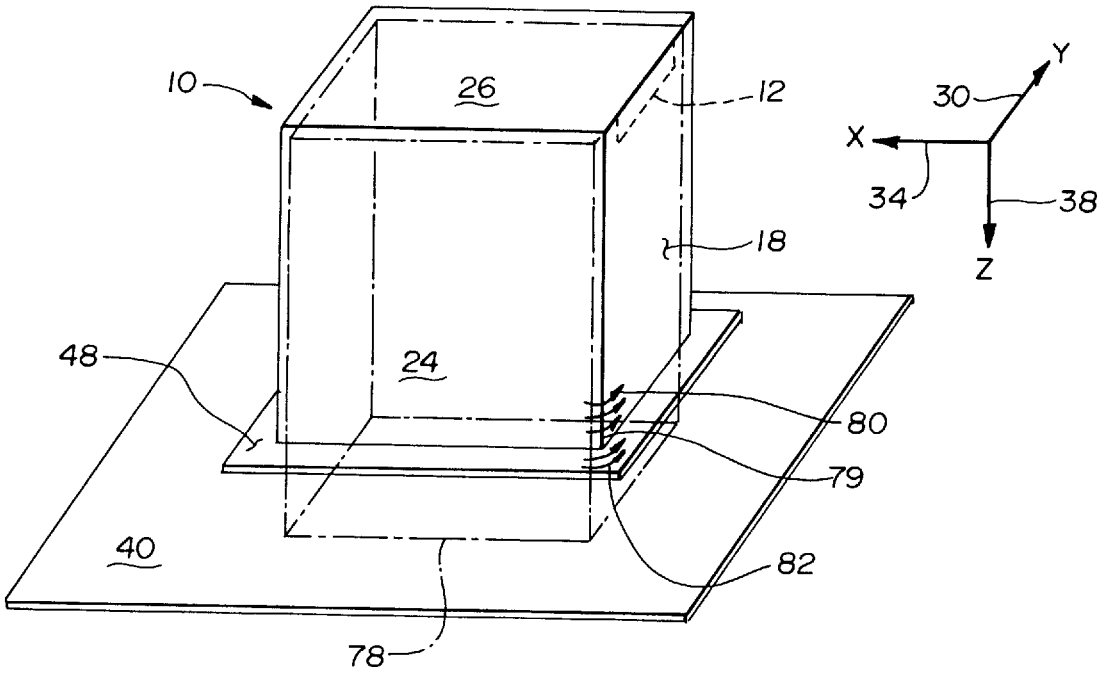
FIG. 5 is a perspective view of the applicator of FIGS. 1 and 2 of the present invention including greatly simplified views of currents in a corner region of the applicator and the cavity in phantom.

The leakage properties of the system can be assessed as follows, with reference to FIG. 5. Two types of fields exist at adjacent sides of the open end of the applicator 10. Taken together, the bottom edges of the four sides of the applicator 10 define an opening facing the plate 40 beneath the load 42. One type of field exists at the x-directed walls (that with the feeding slot, and the opposite wall) and another type of field exists at the y-directed walls. Referring first to the field at the x-directed walls, the applicator end is located so that $h_c \approx \lambda_g/2$. The vertically directed H field becomes strongest at the corner 79, creating a strong horizontally directed wall current indicated by arrows 80. The continuity of the current will result in a strong current (indicated by arrows 82 in the horizontal flange 48 of applicator 10. This current is then linked to an outward-directed H field in the region just below the flange 48. The E field is very weak in this region, which means that the local field impedance is very low. Since the H field in this region is essentially parallel to the prospective direction of energy leakage (the unwanted Poynting vector direction), there are two reasons for low leakage: the H field direction and the low field impedance. In the central area of the vertical wall 18 near the flange 48 there will be no H field but some E field (y-directed). If the y-directed standing wave in the applicator cavity is maintained, there will thus be minimum leakage due to the E field mainly being horizontal and thus essentially parallel to the prospective unwanted Poynting vector. Another way of assessing the situation is by considering the opening area and the horizontal metal planes defined by flanges 48 and plate 40 (the ground plane) as the space where an x-propagating mode exists. This mode cannot be a TEx mode with vertical index 0, which would be the only non-evanescent mode type, since there is a significant z-directed H field below the applicator corner region 78. The flange 48 thus in effect stops propagation out from the region below the applicator 10.

The other two applicator side regions or walls (y-directed) are in many respects similar to the x-directed side regions or walls. However, the horizontal y-directed H field strengths are only half of the corresponding x-directed below the x-directed walls due to the mode index relationship. This results in even less energy coupling out of the system in the region below the flanges 48 in the y-directed side regions than for the x-directed side regions.

It may thus be seen that the applicator 10 with horizontal flanges 48 creates a low microwave leakage to the outside, so that a persistent field pattern in the load 42 is created and adjacent applicators will not interfere with another.

The horizontal width 49 of the flanges 48 (see FIG. 2) is determined by the requirement that the cutoff modes having outwardly directed E field components generally in the middle regions of the side walls be strongly damped. It is to be understood that the direction of propagation from this region is in the x and y directions, and that the simplest mode acting in this region is of the TM type. The properties of the $TM_{11}$ mode are of interest here for the opening between the flanges 48 and the ground plate 40. The power decay distance dd is defined to be the distance in the (local) direction of propagation where the power density has decayed to 1/e, where e is the Naperian base. In practice, it has been found preferable to use $3d_d$ to limit the leakage power density to 5% of that emanating from the cavity. It is to be understood that a lossy load 42 may reduce the requirement for additional width in the flanges 48. Furthermore, adjacent applicators may share a common intermediate flange. It has been found that a 35 mm flange width is adequate for most applications, even with a low-loss load and a $h_0$ distance of 50 mm.

It is to be understood that a number of cavity cross section dimensions can be chosen to give all or several of the favorable conditions described above. The only smaller cross section dimensions for the $TEy_{11}$ mode to dominate are about 80×160 mm. It has to be fed at the upper part of a large vertical side wall. This applicator cross section area may, however, be too small for some applications since the power density in the load becomes higher than with dimensions according to the previously described embodiments.

If the cross section dimensions are made much larger than that of the examples above, controlling undesired or spurious modes becomes more complicated. The next largest suitable square cross section applicator is that for $TEy_{42}$. However, other undesired modes may become efficient for certain narrow ranges of load positions or geometries and will reduce the predictability of the applicator operation. Introducing metal elements in the applicator to enhance the desired mode and filter out undesired modes can be used to improve the operation of such larger applicators, but with increased complexity and cost. Since square cross section applicators are generally easier and more practical to design into multi-applicator systems, the square examples given above are the preferred embodiments. Since there is no need to make the horizontal dimension with index 1 (in the y direction in the examples here) larger than about $\lambda_0$, only the aforementioned $TEy_{11}$ and the $TEy_{31}$ modes, along with the preferred $TEy_{21}$ mode are believed to be of significant interest for practical applicator designs according to the present invention. Typical cross section dimensions for the $TEy_{31}$ mode are 155×230 mm, with the same height as for the other applicators described above.

If the applicator effective height (for any of the previously described TEy modes) is instead chosen to be about one vertical wavelength $\lambda_g$ high, the filtering out of undesired modes may be enhanced.

In a multi-applicator system, the non-symmetrical field pattern fulfilling the object of the invention can be compensated for by turning every second applicator in an array by an angle, e.g., 90°, around the vertical or longitudinal axis. Since the major heating pattern has three elongated areas in the y direction with an intensity which is essentially a sine squared function in this direction (see FIG. 4), more elaborate applicator-to-applicator orientations and displacements may be used for multi-applicator systems. In practice, a displacement equal to ⅓ of the side length a is in general satisfactory.

If a high power density is desired and sufficient power cannot be achieved by using one magnetron per applicator, two or even four magnetrons can be employed. One approach is to have two coupling slots, with one at each of two adjacent side walls. Since the hybrid modes become orthogonal, i.e., uncoupled, and the magnetrons do not oscillate coherently, the energy coupling between the magnetrons will become insignificant, provided the load is reasonably homogeneous and does not create any irregular current patterns. Another approach is to use magnetrons with power supplies fed in anti-phase (e.g., out-of-phase, non-overlapping half-wave supplies); their coupling slots may then be either at opposite or adjacent applicator walls, since a magnetron will not absorb power when not energized. Using both the methods described above enables the use of 4 magnetrons with the square cross section $Tey_{21}$ mode applicator.

If the operating frequency is lower than that in the allowed frequency band centered at 2450 MHz, the multi-source executions just described may be preferable. If an allowed frequency in the band centered about 915 MHz is used, all dimensions given above are to be multiplied with 2450/915≈2.68, and the side of the square cross section applicator dimension then becomes about 423 mm for the larger version of the preferred embodiment and 385 mm for the smaller example square applicator.

The steps in the process of determining dimensions for the applicator of the present invention may be summarized as follows:

1. Select a desired predetermined frequency, e.g., 2450 MHz, and determine if the desired treatment area of the applicator is above the practical minimum limits of about $\lambda_0/2$ by about $3\lambda_0/4$. If it is, proceed; if not, this design process will likely not be suitable, at least for the selected predetermined frequency.

2. Determine the Brewster TM mode condition normalized wavelength in the load $\nu_B$ from $\nu_B^2=|\epsilon|/(|\epsilon|+1)$, where $\epsilon$ is the permittivity of a continuous load which will cover the whole applicator open area. If the load is made up of discrete items, it has been found that an equivalent $\epsilon$ value of about half the actual value may be used. Note also that for drying applications, the permittivity of the load may decrease during the drying operation, so a lower than initial value may desirably be used. It has been found that, in practice, most loads can be characterized by a "high" permittivity having an absolute value of about 10 or a "low" permittivity of about 3.

Iteratively proceed through the following steps:

3. Select a value for the mode index n. Initially and most desirably set n=1 to allow a simple slot feed and minimize problems with unwanted modes. It is to be understood that n=1 is a practical and feasible limitation in the design process, but is not to be taken as limiting the scope of the present invention.

4. Determine a suitable "b" dimension from the denominator of the TEy portion of Equation (4) and taking into account practical limitations for the applicator. The term $z=n\lambda_0/2b$ is desirably less than about ½ and preferably less than about ⅓. For example, b is 184 mm at 2450 MHz for n=1, and z=⅓. It is to be understood, of course, that the smaller the term z becomes, the less influence it will have on the wave impedance determined by the TEy portion of Equation (4).

5. Determine an appropriate combination of dimension "a" and mode index m which fulfill the general applicator size criteria using the diophantic (Diophantine) Equation (3) with the values of $\lambda_0$, n and b (with $\nu$ set equal to $\nu_B$), previously determined. (For a simple square version, "a" may be set equal to "b.") It has been found preferable to proceed with increasing values of m, starting with m=1 in the first iteration through these steps. In the event of multiple solutions, give consideration to double feeds.

6. Determine the value of $\nu$ from Equation (3) and check the dimensional sensitivity. If $\nu>0.95$, return to steps 3, 4, and 5 and select a new set of values for some or all of n, "a," "b," and m.

7. Determine the impedance, $\eta_{g0}$, for the mode of interest using the TEy portion of Equation (4) with $\epsilon=1$ for the air space in the cavity.

8. Determine the impedance of the load, $\eta_{g\epsilon}$, using the TEy portion of Equation (4) with the permittivity determined in step 2 above.

9. Test the quotient of $\eta_{g0}/\eta_{g\epsilon}$. If Equation (3) in step 5 has been satisfied exactly, this quotient will equal 1, otherwise an acceptable range for the quotient is between 1 and about 3 and preferably between 1 and about 2. Values greater than 3 may also be acceptable if the feed matching is initially adjusted for the resulting reflective load situation (resonance, in step 12). If the quotient is not acceptable, return to steps 3, 4, and 5 and select a new set of values for some or all of n, "a," "b," and m.

10. Calculate the ν values using the diophantic Equation (3) of all undesired TEz, TMz, and TEy modes with all possible combinations of indices m and n equal to or lower than those used in step 5, with the previously determined "a" and "b" dimensions.

11. Determine the guide wavelength using $\lambda_{g0}=\lambda_0/\sqrt{1-\nu^2}$ for the desired and undesired modes which may be present in the cavity.

12. Set the applicator longitudinal height h plus the distance from the applicator to the load (which will be between $h_1$ and $h_0$ depending upon the type of load, determined empirically) equal to $p\lambda_{g0}/2$ for the desired mode, where p is an integer and is initially preferably selected equal to 1. Note: this procedure is to make the applicator cavity resonant; this is helpful only if $|r|^2$ is significant, where $r=(z-1)/(z+1)$, and z is the quotient from step 9; otherwise, the transmission line and magnetron matching can be adjusted by a post or similar structure in the feed waveguide between the magnetron and the feed slot in the wall of the applicator. It is also to be understood that it is easier to make a non-resonant applicator for the desired mode antiresonant for the undesired modes, since there is then no height restriction for the desired mode when $|r|^2$ is negligible.

13. Divide the longitudinal height of the cavity determined in step 12 by $\lambda_{g0}/2$ to at least two decimal places for all possible undesired modes.

14. If the result of step 13 is within 10% of an integer for all practical heights, the applicator dimensions cannot be used (because the undesired mode under consideration is resonant in the cavity), and at least one of the cavity dimensions must be changed. If the cavity of the applicator can be made non-resonant for the desired mode, the longitudinal height is preferably changed.

15. For those modes which do not meet the criterion of step 14, determine the $\eta_{g0}$ impedance of the modes using Equation (4).

16. Test the quotient $\eta_{g0}/\eta_{g\epsilon}$ for those values of $\eta_{g0}$ determined in step 15. The acceptable range for values of this quotient is greater than 2. If the quotient is not within the acceptable range, repeat steps 3–16 until an acceptable result is achieved where all desired parameters are simultaneously met.

The invention is not to be taken as limited to all of the details thereof as modifications and variations thereof may be made without departing from the spirit or scope of the invention. For example, it is within the scope of the present invention to use an enclosure closed on all six sides for the applicator. In such an embodiment (not shown) a door or other access is to be provided to enable insertion and withdrawal of the load from the cavity. The load is to be supported on a shelf spaced apart from the bottom wall of the enclosure, as is conventional and the remaining aspect of the present invention may be fully practiced with such a completely enclosed applicator.

What is claimed is:

1. A rectangular microwave applicator operating at a predetermined frequency and comprising a microwave enclosure forming a cavity having first and second transverse dimensions and a longitudinal dimension in the direction of propagation of microwave energy, wherein each of the first and second transverse dimensions are sized to support only one hybrid mode having a low longitudinal impedance and an absence of a transverse E field component in one of the first and second transverse directions such that a load placed having edges inside the cavity in a region adjacent a downstream end of the enclosure is evenly heated without edge overheating.

2. The applicator of claim 1 wherein the microwave enclosure is open-ended and the applicator further comprises a metal ground plate spaced apart from the open end of the enclosure.

3. The applicator of claim 2 wherein the open end of the applicator is surrounded by flanges extending in the first and second transverse directions by a distance sufficient to prevent substantial leakage of microwave energy away from the enclosure.

4. The applicator of claim 1 wherein the enclosure is closed on all six sides.

5. The applicator of claim 1 wherein the first and second transverse dimensions are selected according to the equations:

$$\nu^2 = (\lambda_0)^2[(m/2a)^2 + (n/2b)^2]$$

and $$\eta_g = (\eta_o\sqrt{|\epsilon| - \nu^2})/[|\epsilon| - (n\lambda_o/2b)^2] \text{ for a } TEy \text{ mode,}$$

to provide one or more desired hybrid modes having a longitudinal impedance generally matching the impedance of the load and having an absence of a transverse E field component in one of the first and second transverse directions, where $|\epsilon|$ is the absolute value of the relative permittivity of the load, m and n are the number of half periods of the standing wave pattern in the first and second transverse directions, a and b are the first and second transverse dimensions, ν is the normalized wavelength, $\lambda_0$ is the free-space wavelength at the predetermined frequency, $\eta_g$ is the longitudinal wave impedance in the cavity, $\eta_0$ is the free space wave impedance, and $\epsilon=1$ for the empty space in the cavity.

6. The applicator of claim 5 wherein the longitudinal dimension is selected to provide generally anti-resonant conditions for modes capable of being supported in the cavity and which have a transverse E field component present therein.

7. The applicator of claim 1 wherein the cavity has a feed port delivering microwave energy at the predetermined frequency to the cavity, the feed port having a generally long and narrow aperture in a side wall of the applicator with a long dimension the aperture of approximately one half the free space wavelength of the predetermined frequency such that the microwave energy delivered to the cavity through the feed port excites only those hybrid modes having the absence of a horizontal E field component in one of the transverse directions to avoid overheating an edge of a load aligned with the one transverse direction having the absence of a horizontal E field component.

8. The applicator of claim 1 wherein the transverse E field component of the hybrid mode excited in the other of the transverse directions is sufficiently weak to avoid overheating of an edge of a load aligned with the other of the transverse directions.

9. The applicator of claim 1 wherein the predetermined frequency is 2450 MHz and the first transverse dimension is about 151 to about 165 mm to support a $TEy_{21}$ mode in the cavity when the permittivity of the load is about 3.

10. The applicator of claim 9 wherein the second transverse dimension is selected to be equal to the first transverse dimension.

11. The applicator of claim 9 further comprising a longitudinal dimension of about 120 to about 140 mm.

12. The applicator of claim 9 further comprising a longitudinal dimension of about 240 to about 280 mm.

13. The applicator of claim 1 wherein the predetermined frequency is 2450 MHz and the first transverse dimension is about 137 to about 151 mm to support a $TEy_{21}$ mode in the cavity when the permittivity of the load is about 10.

14. The applicator of claim 1 wherein the predetermined frequency is 2450 MHz and the first transverse dimension is about 151 mm to support a $TEy_{21}$ mode in the cavity when the permittivity of the load is between about 3 and about 10.

15. The applicator of claim 1 wherein the predetermined frequency is 915 MHz and the first transverse dimension is about 404 to about 442 mm to support a $TEy_{21}$ mode in the cavity when the permittivity of the load is about 3.

16. The applicator of claim 15 wherein the second transverse dimension is selected to be equal to the first transverse dimension.

17. The applicator of claim 15 further comprising a longitudinal dimension of about 321 to about 375 mm.

18. The applicator of claim 15 further comprising a longitudinal dimension of about 643 to about 752 mm.

19. The applicator of claim 1 wherein the predetermined frequency is 915 MHz and the first transverse dimension is about 367 to about 404 mm to support a $TEy_{21}$ mode in the cavity when the permittivity of the load is about 10.

20. The applicator of claim 1 wherein the predetermined frequency is 915 MHz and the first transverse dimension is about 404 mm to support a $TEy_{21}$ mode in the cavity when the permittivity of the load is between about 3 and about 10.

21. The applicator of claim 1 wherein the effective longitudinal dimension of the cavity substantially equals an integer multiple of one half the guide wavelength at the predetermined frequency for the desired hybrid mode.

22. The applicator of claim 21 wherein the effective longitudinal dimension of the cavity substantially equals an odd integer multiple of one quarter of the guide wavelength at the predetermined frequency for at least some undesired modes supportable in the cavity other than the desired hybrid mode such that said some undesired modes are made antiresonant.

23. The applicator of claim 22 wherein the impedance of each undesired mode supportable in the cavity other than said undesired modes made antiresonant is mismatched to the impedance of the load.

24. The applicator of claim 23 wherein the ratio of the impedance of each undesired mode other than said some modes made antiresonant to the impedance of the load is greater than about 2.

25. The applicator of claim 1 further comprising a conveyor for transporting a load past the open end of the applicator in one of the transverse directions.

26. The applicator of claim 25 wherein the conveyor further comprises a support of microwave transparent material.

27. The applicator of claim 26 wherein the missing E field component is oriented in the first transverse direction.

28. A method of sizing a cavity for a microwave applicator comprising the steps of:

a) selecting transverse dimensions for a microwave cavity to support only one or more desired hybrid modes having an E field component absent in a first transverse direction;

b) minimizing any E field component in a second transverse direction;

c) locating a transversely oriented elongated aperture in a wall of the cavity with the aperture having a long dimension within the range of approximately 0.9 to 1.5 times the free space wavelength of the microwave frequency to excite only the desired hybrid modes having the absence of an E field component in the first transverse direction; and d) selecting a longitudinal dimension in the direction of propagation of energy in the cavity to mismatch any undesired modes to a load and to match the desired hybrid modes having the absence of an E field component in the first transverse direction to the load to be heated such that any undesired modes have either a high impedance or an anti-resonance condition, decoupling them from the load, such that the absence of an E field component in the one transverse direction avoids overheating of an edge of the load aligned with that transverse direction, and the minimizing of the E field component in the second transverse direction avoids substantial overheating of an edge of the load aligned with the second transverse direction.

29. The method of claim 28 further comprising the additional steps of:

e) forming the applicator as an enclosure having an open end defining a plane; and f) positioning a ground plate away from and parallel to the plane of the open end of the applicator to provide for the dominance of the desired hybrid mode having the absence of a transverse E field component.

30. The method of claim 29 further comprising the additional step of:

g) forming a flange at the open end of the enclosure with the flange extending outwardly from the enclosure in the plane of the open end by a distance sufficient to damp the cutoff modes of microwave energy present in the region between the open end of the enclosure and the ground plate such that microwave energy is substantially prevented from escaping from between the flange and the ground plane.

31. The method of claim 28 further comprising the additional step of:

h) interposing a conveyor between the open end of the enclosure and the ground plane for carrying a load past the open end of the enclosure in a plane parallel to the plane of the open end of the enclosure.

32. A method of constructing a microwave applicator comprising the steps of:

a) selecting a desired predetermined frequency and determining if the treatment area of the applicator is above the practical minimum limits of about $\lambda_0/2$ by about $3\lambda_0/4$;

b) determining a normalized wavelength for a load $\nu_B$ using $\nu_B^2=|\epsilon|/(|\epsilon|+1)$ with a permittivity $\epsilon$ for a load to be placed in the applicator;

iteratively repeating the steps of:

c) selecting a value for the mode index n;

d) determining a suitable transverse "b" dimension for a cavity of the applicator by setting the term $n\lambda_0/2b$ to be less than about ½;

e) determining an appropriate combination of transverse dimension "a" for the cavity and integer mode index m which fulfill the general applicator size criteria using $\nu^2=(\lambda_0)^2[(m/2a)^2+(n/2b)^2]$ with the values of $\nu$, $\lambda_0$, n and b previously determined (using the value of $\nu_B$ initially for $\nu$;

f) determining a value of $\nu$ using $\nu^2=(\lambda_0)^2[(m/2a)^2+(n/2b)^2]$ using the values of $\lambda_0$, m, n, "a" and "b" from step c);

g) checking dimensional sensitivity by testing the result of step f) to determine if $\nu>0.95$; and if so, returning to steps c), d), and e) and selecting a new set of values for at least some of m, n, "a" and "b";

h) determining the impedance, $\eta_{g0}$, for a mode of interest using $\eta_{g0}=(\eta_0\sqrt{|\epsilon|-\nu^2})/[|\epsilon|-(n\lambda_0/2b)^2]$ with $\epsilon=1$ for the air space in a cavity of the applicator;

i) determining the impedance of the load, $\eta_{g\epsilon}$, using the permittivity of the load from step b) in the equation $\eta_{g\epsilon}=(\eta_0\sqrt{|\epsilon|-\nu^2})/[|\epsilon|-(n\lambda_0/2b)^2]$;

j) determining the quotient of $\eta_{g0}/\eta_{g\epsilon}$ for the mode of interest;

k) checking the impedance match calculated in step j) and if the result is greater than 3, returning to steps c), d), and e) and selecting a new set of values for at least some of n, "a," "b," and m;

l) calculating the $\nu$ values of all undesired TEz, TMz, and TEy modes having equal or lower mode indices using $\nu^2=(\lambda_0)^2[(m/2a)^2+(n/2b)^2]$ with the previously determined "a" and "b" dimensions;

m) determining the guide wavelength $\lambda_g=\lambda_0/\sqrt{1-\nu^2}$ for the mode of interest and all undesired modes which may be supported in the cavity; and n) if the quotient from step j) is between 1 and about 2, selecting a longitudinal height for the cavity including the distance to the load equal to about $p\lambda_{g0}/2$, where p is an integer) for the desired mode;

o) dividing the longitudinal height last determined in step n) by half of the guide wavelength, $\lambda_{g0}/2$, to at least two decimal places for all possible undesired modes; and p) testing the result of step o) to determine if the result is within 10% of an integer for any unwanted mode, and if so, discarding the dimensions selected and repeating steps n), o), and p), changing the height directly or by incrementing integer p, and if an acceptable result is not reached satisfying all tests, repeating steps e) through o), first changing dimension "a" and index m, and if this does not produce an acceptable result, repeating steps d) through o) with a new "b" dimension, and if necessary indexing n to another integer value and returning to step c) until all tests are satisfied and proceeding to step q) if one or more undesired modes cannot be made to pass the test of this step p) by adjustment of the longitudinal height;

q) determining both the $\eta_{g0}$ impedance of the TMz modes addressed in step 1) using $\eta_g=(\eta_0\sqrt{|\epsilon|-\nu^2})/|\epsilon|$ and the impedance of the TEy modes addressed in step 1) using $\eta_g=(\eta_0\sqrt{|\epsilon|-\nu^2})/[|\epsilon|-(n\lambda_0 2b)^2]$ r) testing the quotient $\eta_{g0}/\eta_{g\epsilon}$ for those values of $\eta_{g0}$ determined in step p) to see if the quotient is greater than 2; and if not, repeat steps c) through r) until the quotient is greater than 2; and subsequently, once all tests have been satisfied, s) building a microwave applicator out of microwave reflective material such that the applicator has a pair of transverse dimensions "a" and "b" as determined above such that at the predetermined frequency, the cavity has a desired hybrid mode lacking a transverse E field component and a low wave impedance in the longitudinal direction substantially matched to a load to be irradiated by the applicator and wherein all undesired modes able to be supported in the cavity have either a high longitudinal impedance or are in an antiresonance condition in the cavity.

33. A microwave applicator comprising:

a) an enclosure formed of microwave reflective material having a closed first end, four side walls and an open second end; and b) a ground plate spaced apart from and facing the open end of the enclosure, wherein the ground plate extends in a pair of transverse directions and has a longitudinal direction perpendicular thereto, wherein the enclosure and ground plate form a cavity containing one or more desired hybrid modes having a low wave impedance in the longitudinal direction and an absence of an E field component in at least one of the transverse directions, all determined by the transverse dimensions of the cavity and a predetermined frequency for microwaves present in the cavity.

34. A microwave applicator comprising an enclosure formed of microwave reflective material having a six closed walls forming a cavity containing a hybrid mode having a low wave impedance in the longitudinal direction and an absence of an E field component in at least one of the transverse directions, all determined by the transverse dimensions of the cavity and a predetermined frequency for microwaves present in the cavity.

* * * * *